US008464884B2

(12) United States Patent
Shearin

(10) Patent No.: US 8,464,884 B2
(45) Date of Patent: Jun. 18, 2013

(54) BURST PRESSURE SUPPORT RIB

(75) Inventor: Douglas M. Shearin, Madison Heights, MI (US)

(73) Assignee: BASF Corporation, Florham Park, NJ (US)

( * ) Notice: Subject to any disclaimer, the term of this patent is extended or adjusted under 35 U.S.C. 154(b) by 1940 days.

(21) Appl. No.: 11/379,416

(22) Filed: Apr. 20, 2006

(65) Prior Publication Data

US 2007/0246462 A1 Oct. 25, 2007

(51) Int. Cl.
*B65D 6/34* (2006.01)

(52) U.S. Cl.
USPC ..... 220/4.13; 220/4.04; 220/565; 220/4.24

(58) Field of Classification Search
USPC ..... 220/4.04, 4.05, 4.07, 4.12, 4.24, 220/565, 646, 648, 679, 678, 581, 673, 675, 220/4.13
See application file for complete search history.

(56) References Cited

U.S. PATENT DOCUMENTS

| | | | | | |
|---|---|---|---|---|---|
| 563,675 | A | * | 7/1896 | Mullins | 249/52 |
| 3,335,902 | A | * | 8/1967 | Javorik | 220/673 |
| 3,346,137 | A | * | 10/1967 | Ricci | 220/23.6 |
| 3,507,417 | A | * | 4/1970 | Crompton et al. | 220/4.21 |
| 3,586,162 | A | * | 6/1971 | Townsend | 242/137 |
| 3,727,795 | A | * | 4/1973 | Willsey | 220/530 |
| 3,839,981 | A | | 10/1974 | Gilles | |
| 3,861,552 | A | | 1/1975 | Adams | |
| 3,863,460 | A | | 2/1975 | Straile et al. | |
| 4,093,100 | A | | 6/1978 | Ford et al. | |
| 4,182,018 | A | | 1/1980 | Gülicher | |
| 4,603,788 | A | | 8/1986 | Gerhard | |
| 5,169,024 | A | * | 12/1992 | Rinkewich | 220/586 |
| 5,361,930 | A | * | 11/1994 | Perry | 220/565 |
| 5,365,830 | A | * | 11/1994 | MacLennan et al. | 99/276 |

* cited by examiner

*Primary Examiner* — Stephen Castellano
(74) *Attorney, Agent, or Firm* — Howard & Howard Attorneys PLLC

(57) ABSTRACT

A container assembly having a tank with first and second sides for storing materials under pressure. A plurality of hoop stringers surround each half of the tank and cross one another to define joints. The hoop stringers extend radially outward at various points, including the crossing of the hoop stringers, to increase a cross sectional area of the hoop stringers.

21 Claims, 2 Drawing Sheets

BURST PRESSURE SUPPORT RIB

BACKGROUND OF THE INVENTION

1. Field of the Invention

The subject invention relates to a container assembly and, more particularly, to a tank for storing materials under pressure.

2. Description of the Prior Art

Pressure vessels, also known in the prior art as tanks, are commonly used for storing liquid gases at low and high pressure. In the case of tanks containing high pressures, various constructions are employed in order to withstand the associated high operating pressure levels. One construction utilized employs a longitudinal structure around the tank. The structure is commonly referred to as a flange, stringer or weld-flange.

Pressure from the gas and/or liquid is exerted on interior walls of the tank. An excessive amount of pressure can cause the tank to burst. As such, the stringer is constructed to surround the tank and absorb the pressure exerted on the wall of the tank. The typical construction includes a plurality of stringers being joined together at pre-determined assembly joints. The stress exerted on the wall of the tank is absorbed by the stringers and distributed across the stringers and the assembly joints of the stringers.

The assembly joints enable assembly techniques such as fastening, adhesives or welding and are typically flat and possess a small cross sectional area for absorbing the stresses. The small cross sectional area only allows for minimum stress absorption. Although the assembly joints are configured to absorb the stress exerted on the wall of the tank, the assembly joints define a weak point as in the assembly joints tend to be weaker than the geometry they intend to support. When excessive amounts of stress build up at the surface areas of the assembly joints, the assembly joints may deflect and break apart because the small cross sectional area only allows for minimum stress absorption in the presence of multi-axis forces.

SUMMARY OF THE INVENTION AND ADVANTAGES

The present invention provides a container assembly comprising a tank for storing materials under pressure. A plurality of hoop stringers surround the tank and cross one another at at least one intersection to define joints there between. The invention is distinguished by a portion of the hoop stringers extending radially outward to increase a cross sectional area of the stringers for retaining the pressurized materials in the tank.

Accordingly, the present invention provides a container assembly comprising stringers that distribute stress concentrations at the assembly joints across a larger cross sectional area than that utilized in the prior art. The larger cross sectional area allows for a greater amount of stress absorption. This construction minimizes the possibility of the assembly joints deflecting and breaking apart because larger amounts of stress are distributed among a larger surface area in the presence of multi-axis forces.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
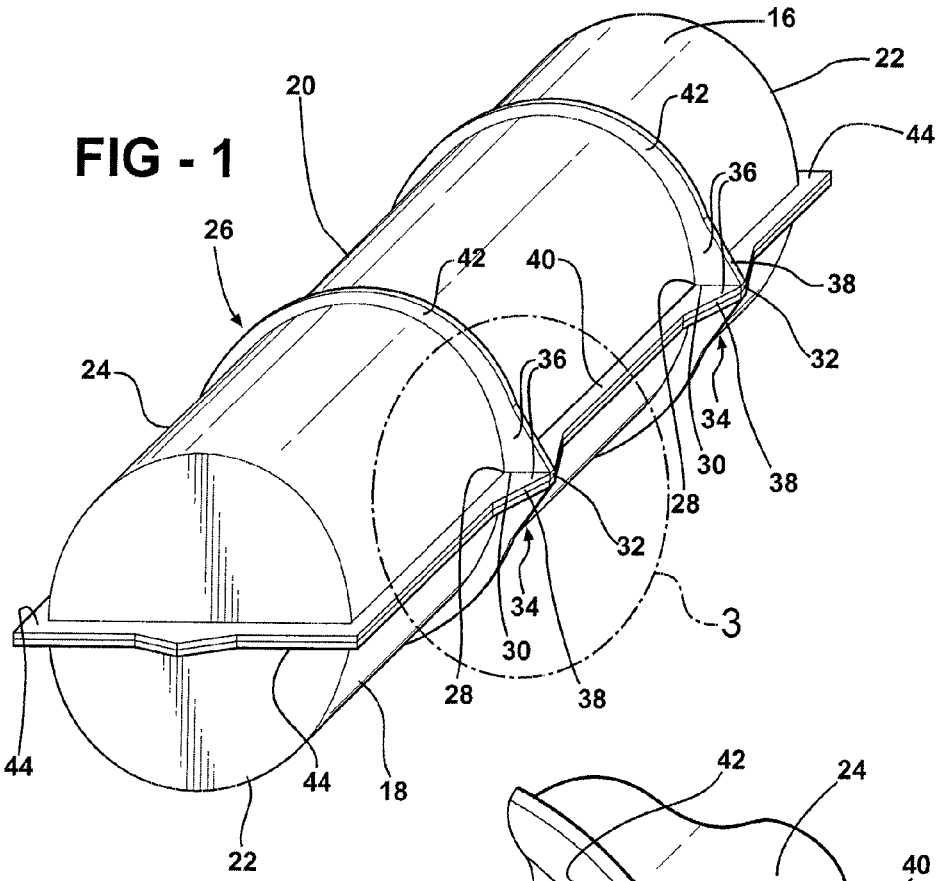
FIG. 1 is a perspective view of a container assembly of the present invention.
Figure 2:
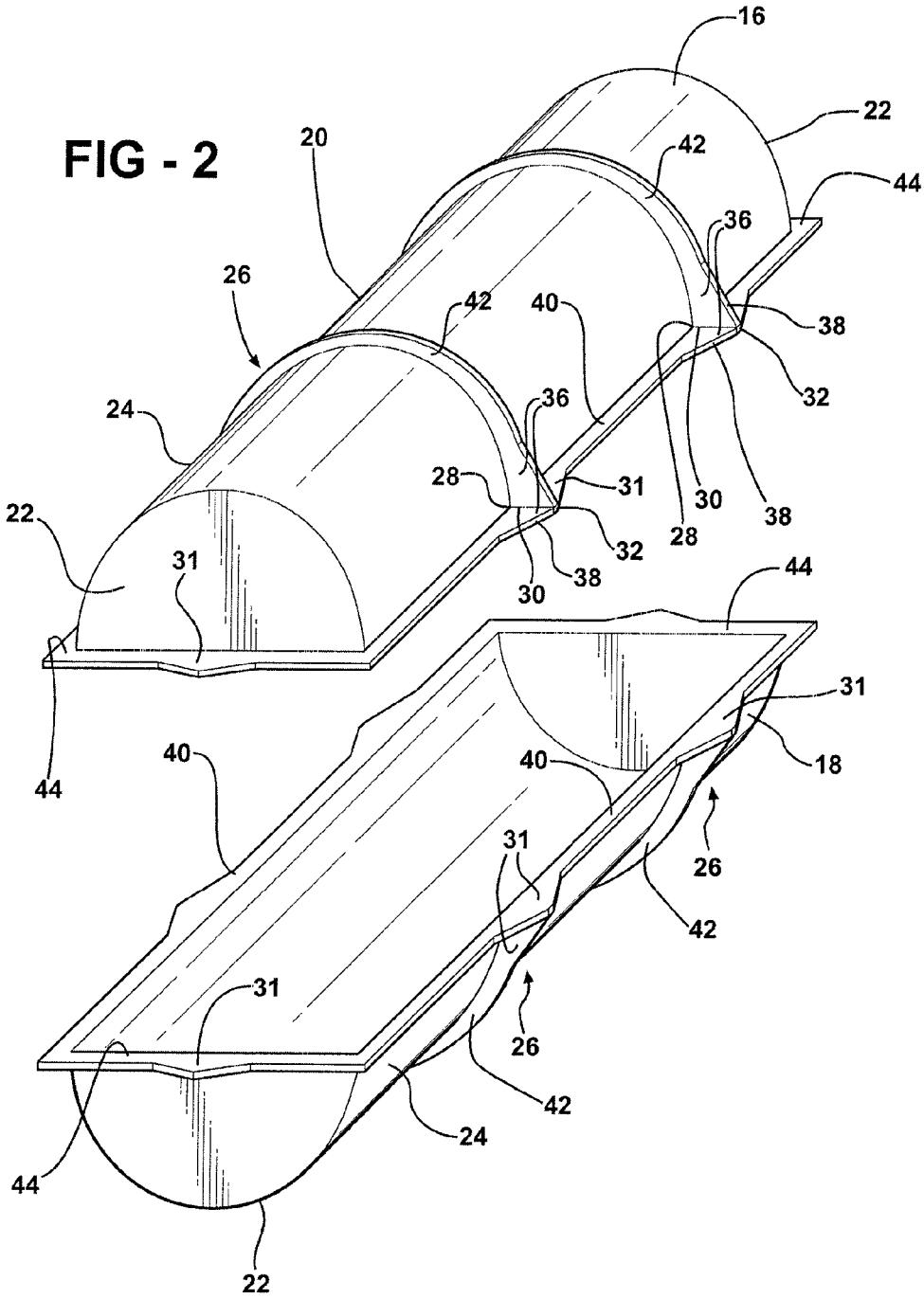
FIG. 2 is an exploded view of a first half and a second half of the container assembly.

Referring to the Figures, wherein like numerals indicate corresponding parts throughout the several views, a container assembly is generally shown in FIGS. 1 and 2 having a tank 20 for storing materials under pressure. The tank 20 includes a first half 16 and a second half 18 with each of the halves 16,18 having an outer periphery and a cylindrical outer surface 24 terminating at flat ends 22. The tank 20 is shown as a closed cylinder but it should be known and appreciated by those skilled in the art that the tank 20 can be shaped differently. For example, and not meant to be limiting, the tank 20 could be spherical or longitudinally extending without a cylindrical shape, etc. As shown, the tank 20 is formed of a rigid polymeric material, such as Nylon, Isoprene, Polypropylene, Polyurethane, or Stylene. As appreciated, the tank 20 could be formed of any suitable material such as, but not limited, to Steel, Aluminum, or Copper. Alternatively, the cylindrical outer surface 24 of the tank 20 could be unitary with the flat ends 22 being welded to the outer surface 24 of the tank 20. Further, the tank 20 could include a plurality of sections in addition to the first 16 and second 18 halves. Also, the tank 20 would typically include an inlet valve (not shown) and an outlet valve (not shown) for infusing and diffusing, respectively, pressurized materials into and out of the tank 20.

Figure 3:
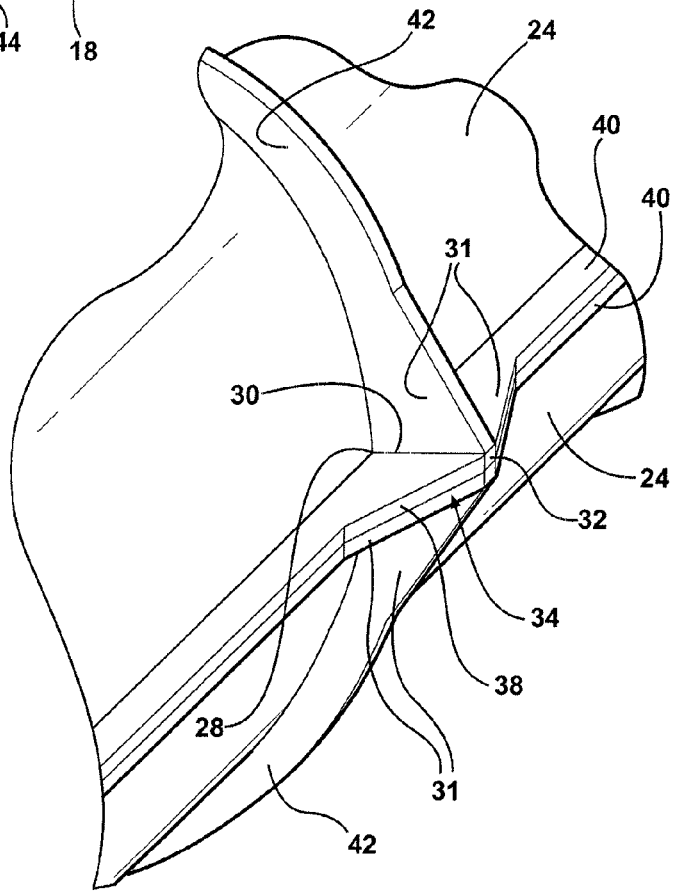
FIG. 3 is an enlarged view of a joint of the assembly.

Referring also to FIG. 3, the container assembly also includes a plurality of hoop stringers 26 surrounding the tank 20 and crossing 28 one another at at least one intersection to define joints 30 there between. It should be appreciated that not every hoop stringer 26 will intersect every other hoop stringer 26. As is apparent from the discussion below, it is only necessary that at least one hoop stringer 26 intersect at least one other hoop stringer 26 to form a joint 30. The hoop stringers 26 are provided to absorb the associated operating pressure stress levels exerted on the tank 20 by the pressurized material within the tank 20. Preferably, the hoop stringers 26 are integral with the tank 20 and are formed of a polymeric material. In the most preferred embodiment, the polymeric material used to form the tank 20 and hoop stringers 26 is Nylon.

The hoop stringers 26 include a longitudinal hoop stringer 40 extending about each outer periphery, a radial hoop stringer 42 extending about each cylindrical outer surface 24, and an end hoop stringer 44 extending about each flat end 22 of the halves 16,18. Preferably, the longitudinal hoop stringer 40 is integral with the outer periphery and extends along a length of each of the halves 16,18 of the tank 20. Even more preferably, each half 16,18 includes a pair of opposing longitudinal hoop stringers 40 with corresponding longitudinal hoop stringers 40 engaging each other such that the tank 20 is enclosed by four longitudinal hoop stringers 40. Preferably, the radial hoop stringers 42 are integral with the cylindrical outer surface 24 and extend around each of the halves 16,18 of the tank 20 to the crossing 28 at the longitudinal hoop stringer 40 to define the joint 30 there between. Even more preferably, each half 16,18 includes a pair of longitudinal hoop stringers 40 such that the tank 20 includes four radial hoop stringers 42. The end hoop stringer 44 is integral with the flat ends 22 at the outer periphery of the halves 16,18 of the tank 20. Even more preferably, each half 16,18 includes a pair of opposing end hoop stringers 44 with corresponding end hoop stringers 44 engaging each other such that the tank 20 is enclosed by four end hoop stringers 44. It should be known and appreciated by one skilled in the art that the number and shape of the hoop stringers 26 used to enclose the tank 20 may vary depending upon the size and style of the tank 20 employed to house the pressurized materials.

A portion 31 of the hoop stringers 26 extend radially outward to increase a cross sectional area of the hoop stringers 26 for retaining the pressurized materials in the tank 20. Preferably, each portion 31 of the hoop stringer 26 terminates at an apex 32. Additionally, each hoop stringer 26 includes an inclined section 38 that leads to the apex 32. The hoop stringers 26 disposed about the outer periphery on each half 16,18 include the portion 31 extending radially outward and are fused together for form the tank 20. Preferably, there are two portions 31 of the hoop stringers 26 on each longitudinal hoop stringer 40 for extending across the cylindrical outer surface 24. Also, preferably, there is one portion 31 of the hoop stringers 26 on each end hoop stringer 44 for extending across the flat ends 22. The fusing of the portions 31, hoop stringers 26 and halves 16,18 is preferably accomplished by welding the hoop stringers 26 together. By example and not meant to be limiting, hot plate, vibration or ultrasonic welding can be performed to fuse the hoop stringers 26 and halves 16,18 together to form the tank 20.

A plurality of the portions 31 of the hoop stringers 26 extend radially outward at the crossing 28 or intersection of the hoop stringers 26 to increase a cross sectional area of the hoop stringers 26 at the joints 30. Preferably, there are two portions 31 of the hoop stringers 26 on each radial hoop stringer 42 for intersecting the portions 31 on each longitudinal hoop stringer 40. Once the halves 16,18 are put together to form the tank 20, the portions 31 of the hoop stringers 26 each define a pyramid 34 having four corners 36 at each joint 30. Each hoop stringer 26 defines a rectangular cross section extending outwardly from the tank 20 whereby the inclined sections 38 of the hoop stringers 26 define the four corners 36 of the pyramid 34 at each joint 30. It should be known and appreciated by one skilled in the art that the cross section of the hoop stringer 26 may be of any suitable design.

Obviously, many modifications and variations of the present invention are possible in light of the above teachings. The invention may be practiced otherwise than as specifically described within the scope of the appended claims.

What is claimed is:

1. A container assembly comprising:

a tank formed of a polymeric material with said tank having a first half and a second half for storing materials under pressure with said first half having a first inner surface and a first outer surface terminating at a first open edge and said second half having a second inner surface and a second outer surface terminating at a second open edge with said edges facing each other when said halves form said tank, said first and second inner surfaces being substantially smooth between said edges, a first longitudinal hoop stringer formed of a polymeric material and mounted to said first outer surface of said first half adjacent said first edge, a second longitudinal hoop stringer formed of a polymeric material and mounted to said second outer surface of said second half adjacent said second edge with said first and second longitudinal hoop stringers facing each other when said halves form said tank, at least one first radial hoop stringer formed of a polymeric material and mounted on said first outer surface and intersecting said first longitudinal hoop stringer to define a first joint there between, and at least one second radial hoop stringer formed of a polymeric material and mounted on said second outer surface and intersecting said second longitudinal hoop stringer to define a second joint there between with said first and second joints aligning with each other, wherein a portion of each of said hoop stringers at said first and second joints extends radially outward beyond a height of each respective hoop stringer with said portions of said hoop stringers including an inclined surface extending from said height of each of said respective hoop stringer to an apex of said joints to increase a cross sectional area of said hoop stringers at said joints for retaining the pressurized materials in said tank.

2. An assembly as set forth in claim 1 wherein said first and second longitudinal hoop stringers disposed about said first and second edges, respectively, are fused together when said halves form said tank.

3. An assembly as set forth in claim 1 wherein said first and second longitudinal hoop stringers disposed about said first and second edges, respectively, are welded together when said halves form said tank.

4. An assembly as set forth in claim 1 wherein said hoop stringers are integrally formed with said tank.

5. An assembly as set forth in claim 1 wherein said polymeric material is further defined as nylon.

6. An assembly as set forth in claim 1 wherein said portions of said hoop stringers define a cruciform shape having four corners at each joint.

7. An assembly as set forth in claim 1 wherein each hoop stringer has a polygonal configuration extending outwardly from said tank when viewed in cross section transverse to said hoop stringer.

8. An assembly as set forth in claim 1 wherein each of said halves include a cylindrical outer surface terminating at flat ends.

9. An assembly as set forth in claim 8 further including an end hoop stringer extending about each flat end of said halves along an edge of each flat end.

10. An assembly as set forth in claim 9 wherein said end hoop stringer is integral with said flat ends.

11. An assembly as set forth in claim 8 wherein said first and second longitudinal hoop stringers are integral with said first and second edges, respectively, and extend along a length of each of said halves of said tank.

12. An assembly as set forth in claim 8 wherein said first and second radial hoop stringers are integral with said cylindrical outer surface of said first and second halves, respectively, and extend around each of said halves of said tank.

13. An assembly as set forth in claim 1 wherein each hoop stringer has a polygonal configuration extending outwardly from said tank when viewed in a cross section transverse to said hoop stringer to a first height with said portions extending outwardly beyond said first height to a second height that is greater than said first height.

14. A container assembly comprising:

a tank having a first half and a second half for storing materials under pressure with said first half having a first outer surface terminating at a first open edge and said second half having a second outer surface terminating at a second open edge with said edges facing each other when said halves form said tank, a first longitudinal hoop stringer mounted to said first half adjacent said first edge, a second longitudinal hoop stringer mounted to said second half adjacent said second edge with said first and second longitudinal hoop stringers facing each other when said halves form said tank, at least one first radial hoop stringer mounted on said first outer surface and intersecting said first longitudinal hoop stringer to define a first joint there between, and at least one second radial hoop stringer mounted on said second outer surface and intersecting said second longitudinal hoop stringer to define a second joint there between with said first and second joints aligning with each other, wherein a portion of each of said hoop stringers at said first and second joints extends radially outward beyond a height of each respective hoop stringer with said portions of said hoop stringers including an inclined surface extending from said height of each of said respective hoop stringer to an apex of said joints to form a cruciform shape and to increase a cross sectional area of said hoop stringers at said joints for retaining the pressurized materials in said tank.

15. An assembly as set forth in claim 14 wherein said tank and said hoop stringers are formed of a polymeric material.

16. An assembly as set forth in claim 14 wherein said first and second longitudinal hoop stringers are integral with said first and second edges, respectively, and extend along a length of each of said halves of said tank.

17. An assembly as set forth in claim 14 wherein said first and second radial hoop stringers are integral with said first and second outer surfaces, respectively, and extend around each of said halves of said tank.

18. An assembly as set forth in claim 14 wherein each hoop stringer has a polygonal configuration extending outwardly from said tank when viewed in a cross section transverse to said hoop stringer to a first height with said portions extending outwardly beyond said first height to a second height that is greater than said first height.

19. A container assembly comprising:

a tank having a first half and a second half for storing materials under pressure with said first half having a first outer surface terminating at a first open edge and said second half having a second outer surface terminating at a second open edge with said edges facing each other when said halves form said tank, a first longitudinal hoop stringer mounted to said first half adjacent said first edge, a second longitudinal hoop stringer mounted to said second half adjacent said second edge with said first and second longitudinal hoop stringers facing each other when said halves form said tank, at least one first radial hoop stringer mounted on said first outer surface and intersecting said first longitudinal hoop stringer to define a first joint there between, and at least one second radial hoop stringer mounted on said second outer surface and intersecting said second longitudinal hoop stringer to define a second joint there between with said first and second joints aligning with each other, wherein a portion of each of said hoop stringers at only said first and second joints extends radially outward beyond a height of each respective hoop stringer with said portions of said hoop stringers including an inclined surface extending from said height of each of said respective hoop stringer to an apex of said joints to increase a cross sectional area of said hoop stringers at only said joints for retaining the pressurized materials in said tank.

20. An assembly as set forth in claim 19 wherein said tank and said hoop stringers are formed of a polymeric material.

21. An assembly as set forth in claim 19 wherein said portions of said hoop stringers define a cruciform shape having four corners at each joint.

* * * * *